United States Patent [19]

Greenberger

[11] Patent Number: 4,488,710

[45] Date of Patent: Dec. 18, 1984

[54] APPARATUS FOR OPTIMIZING THE COOLING OF A GENERALLY CIRCULAR CROSS-SECTIONAL LONGITUDINAL SHAPED WORKPIECE

[75] Inventor: Joseph I. Greenberger, Pittsburgh, Pa.

[73] Assignee: Wean United, Inc., Pittsburgh, Pa.

[21] Appl. No.: 529,822

[22] Filed: Sep. 6, 1983

[51] Int. Cl.[3] ..... C21D 1/62

[52] U.S. Cl. ..... 266/114; 134/122 R; 72/201; 266/259; 266/115

[58] Field of Search ..... 72/201; 134/122 R, 64 R; 266/111-113, 114, 115, 117, 131, 134, 106, 259

[56] References Cited

U.S. PATENT DOCUMENTS

| | | | |
|---|---|---|---|
| 3,856,281 | 12/1974 | Bertolotti et al. | 134/64 R |
| 3,858,860 | 1/1975 | Randall | 134/122 |
| 3,861,597 | 1/1975 | Tsuicamura et al. | 239/536 |
| 3,889,507 | 6/1975 | Kraneenberg et al. | 72/201 |
| 3,949,585 | 4/1976 | Wagner | 72/201 |
| 3,986,710 | 10/1976 | Day et al. | 266/129 |
| 4,000,625 | 1/1977 | Beerens et al. | 62/63 |
| 4,047,985 | 9/1977 | Greenberger | 148/153 |
| 4,076,222 | 2/1978 | Schaming | 266/111 |
| 4,084,798 | 4/1978 | Dewsnap et al. | 266/131 |
| 4,197,730 | 4/1980 | Paulitsch et al. | 72/201 |
| 4,210,010 | 7/1980 | Vlad et al. | 72/201 |
| 4,210,288 | 1/1980 | Dobson | 239/597 |

FOREIGN PATENT DOCUMENTS

| | | | |
|---|---|---|---|
| 1216966 | 5/1957 | Fed. Rep. of Germany | 266/111 |
| 692868 | 10/1979 | U.S.S.R. | 266/1.4 |

*Primary Examiner*—L. Dewayne Rutledge
*Assistant Examiner*—Christopher W. Brody
*Attorney, Agent, or Firm*—Daniel Patch; Suzanne Kikel

[57] ABSTRACT

An apparatus for distributing curtain walls of coolant around a passing hot rolled, extruded, or drawn round, metal article, and optimizing the cooling thereof. A circular liquid coolant header comprises an enclosure divided into two abutting annular compartments; the first compartment containing a smaller annular concentric compartment with openings communicating with the second abutting compartment, which, in turn, has several circumferentially positioned and evenly spaced nozzle assemblies for delivering the curtain walls. A nozzle assembly is located between two semi-round compartment inlets which receive coolant from the first compartment and diffuse and direct the coolant flow into a respective nozzle assembly.

8 Claims, 3 Drawing Figures

APPARATUS FOR OPTIMIZING THE COOLING OF A GENERALLY CIRCULAR CROSS-SECTIONAL LONGITUDINAL SHAPED WORKPIECE

BACKGROUND OF THE INVENTION

The invention relates to the uniform cooling of such articles as a hot, cast, rolled, or extruded generally circular metal workpiece, such as a billet, a rod, a bar or a tube, issuing from a continuous caster, a hot rolling mill, or an extrusion press, respectively. More particularly, it relates to an apparatus and a method where several curtain walls of coolant are applied to the outer peripheral surface of the workpiece along a horizontal passline between the rolling mill stands and/or at the runout section, or where coolant is applied to the extruded workpiece immediately as it leaves the die.

As is well-known in the art, coolant is applied to control the finishing temperature of a workpiece. It also acts to suppress oxide formation at various stages of the rolling process including coiling, or gathering thereof.

Several types of cooling systems and methods are presently being practiced for the cooling of hot rolled rod or bar after the last rooling stand of a finishing train or after the extrusion process in the runout section. As disclosed in U.S. Pat. No. 4,084,798, one type involves a number of open ended, tandemly arranged troughs having slots for directing streams of water onto the workpiece. Another type involves a series of boxes containing high pressure water sprays for cooling rod or bar as it passes therethrough. Another system involves a plurality of tandemly arranged cooling tubes containing water in which the workpiece is immersed and through which it travels.

All of these above systems have several severe disadvantages, which are non-uniform cooling, limited cooling capacity, and poor efficiency in terms of the quantity of water used per unit of heat removed in the available space which may result in low production. The workpiece is not uniformily or efficiently cooled along the outer surface of the workpiece, often resulting in a non-uniform microstructure, and thus, non-uniform metallurgical characteristics and physical properties. Also, due to the non-uniform and less efficient cooling, the oxide formation varies and unacceptable surface conditions exists.

Another disadvantage of prior systems becomes very evident in the increased speeds in which the workpiece to be cooled travels in modern mills and presses, and the time it takes for the workpiece to reach its required temperature. These considerations require that the runout section, usually consisting of several sprays and/or troughs and tubes, extend a considerable distance thereby occupying a substantial amount of plant area.

Spray units may be positioned between the roughing, intermediate, and finishing trains and/or the stands thereof to control the temperature of a hot rolled workpiece. U.S. Pat. No. 3,889,507 illustrates a water cooling apparatus positioned between mill trains, and containing several spray nozzles arranged to apply coolant longitudinally and onto the circumference of a workpiece. Here, again, it can be shown that, in addition to the well-known inefficiencies of high pressure spray systems, a non-uniform cooling on the surface will occur. Since several spray nozzles are needed to obtain the desired cooling effect, this apparatus in the aforesaid '507 patent extends a substantial length. In some instances, several water cooling apparatuses may be necessary, thereby occupying a great amount of space. It is also to be noted that this '507 patent sets forth another disadvantage inherent with troughs and tubes in that since vapor blankets form around the metal, the cooling efficiency of the water is greatly reduced.

It is an object of the present invention to provide an apparatus to optimize the rate of cooling to produce a finishing temperature of a heated, solid generally round metal workpiece which will give a desirable microstructure, reduce the growth of surface oxides, and improve surface conditions, and to achieve this by occupying an area substantially smaller than that required by previous cooling systems.

It is a further object of the present invention to provide an apparatus at the runout section of a mill or press, and/or between stands in a mill which will deliver curtain walls of coolant which evenly cool a round, heated metal workpiece so that a more desirable microstructure is obtained in the workpiece in the case of a runout section, and an increased production rate is obtained in the instance of having the apparatus located between stands.

A further object of the present invention is to provide an annular header having a center opening through which a workpiece travels, and which has several, evenly spaced nozzles each having an elongated opening extending parallel to the path of travel of the workpiece and each located radially relative to the workpiece, for delivering low pressure curtain walls of coolant along a longitudinal portion of the workpiece.

These and other objects of the present invention will be better appreciated when the following description of an embodiment is read along with the accompanying drawings of which:

As a hot workpiece travels between the stands, or exits from a rolling mill stand or die assembly of an extrusion press, its temperature is decreased by applying several low pressure, and thus, low turbulent curtain walls of liquid coolant longitudinally onto a moving workpiece. These curtain walls of coolant are delivered by a header mounted in a manner to receive the workpiece as it travels along a substantially horizontal passline defined by the roll bite or die opening, and the header's inlet pressure is less than 20 psi and the exit pressure of the curtain walls are less than 3 psi.

Figure 1:
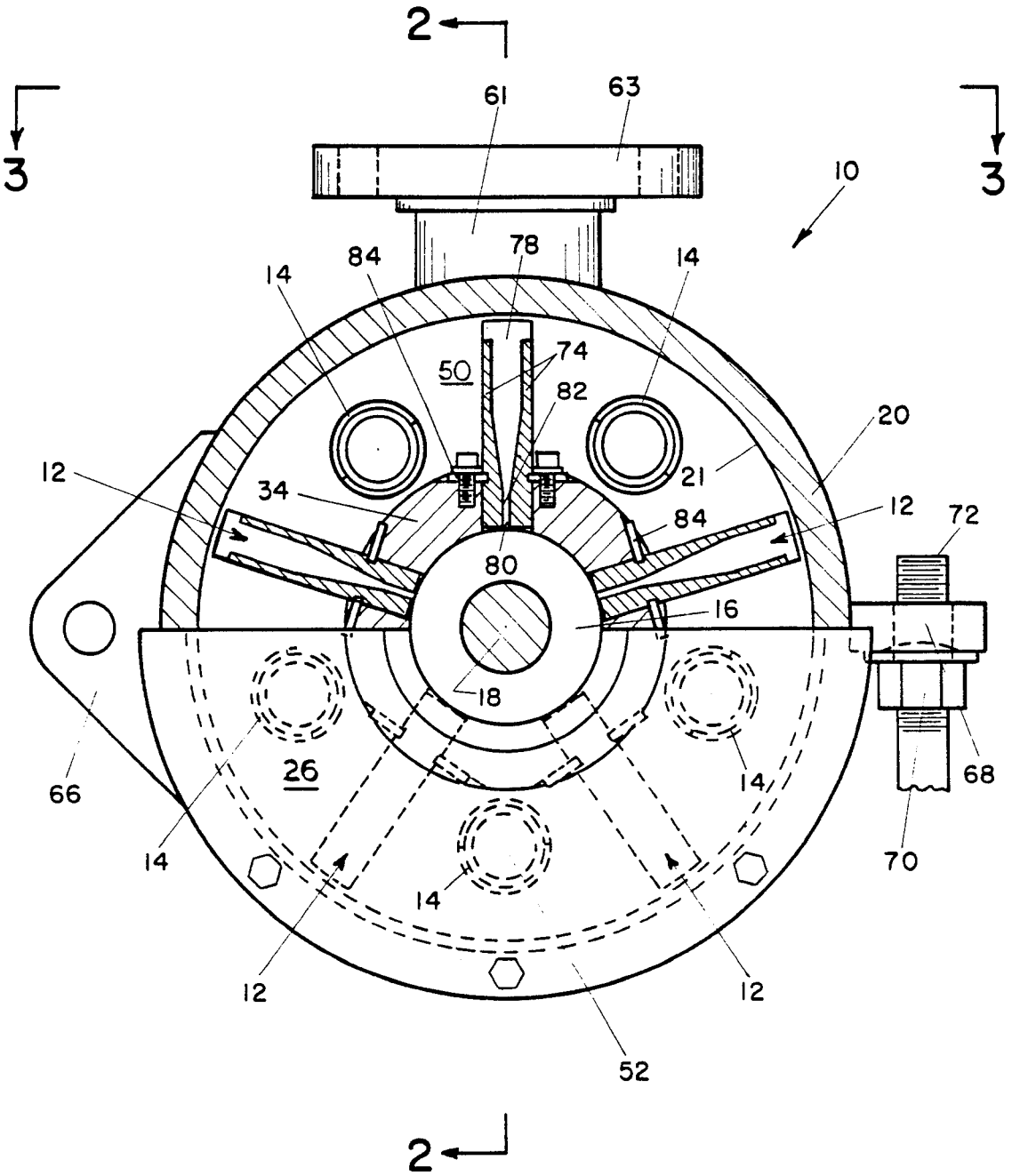
FIG. 1 is a partly cross-sectional, elevational view of an apparatus incorporating the features of the subject invention.
Figure 2:
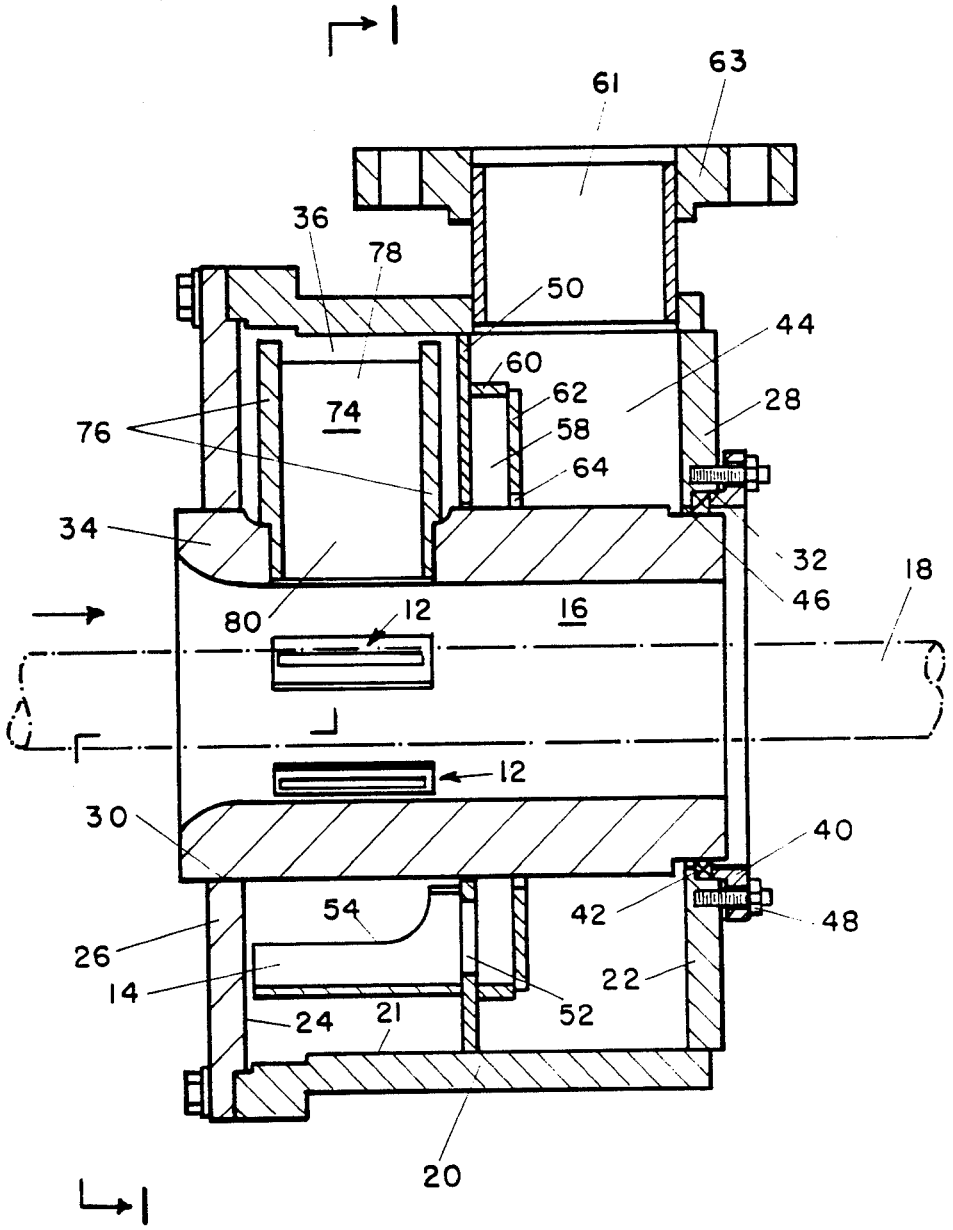
FIG. 2 is a cross-sectional view taken along lines 2—2 of FIG. 1.
Figure 3:
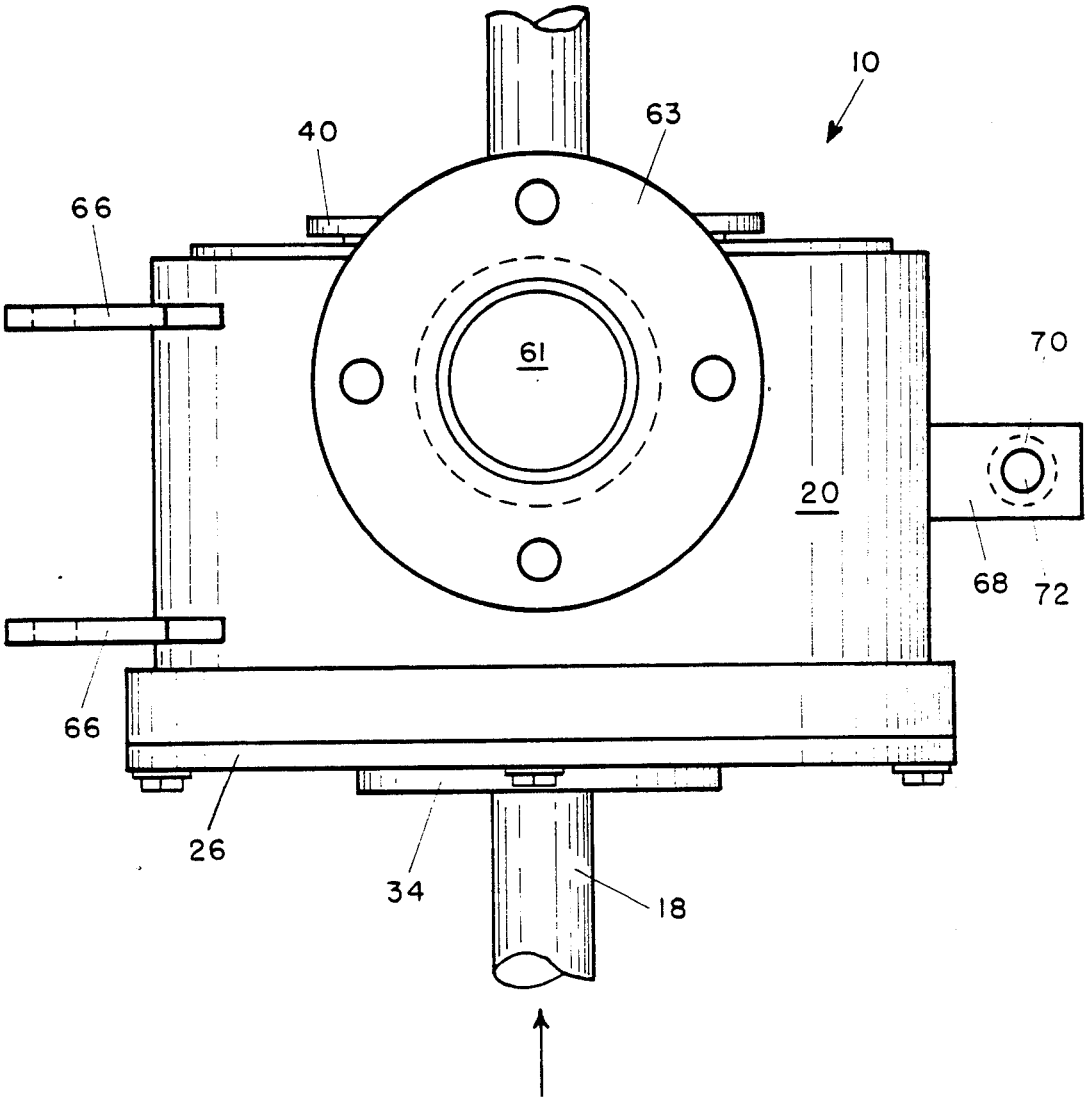
FIG. 3 is a plan view taken along lines 3—3 of FIG. 1.

The design of this coolant header is the essence of the subject invention, and such header is shown at 10 in FIGS. 1–3, where like numerals designate like components. For the given parameters of the workpiece or product, including its diameter and speed, its temperature prior to cooling and the amount of heat to be removed, the number of nozzles, the volume of coolant, and the dimensions of the curtain wall are selected to give the desired production rate, the scale suppression rate and/or the metallurgical results for the workpiece.

In referring first to FIG. 1, water header 10 receives a predetermined volume of water and comprises severally, evenly-spaced nozzle assemblies 12 between which semi-circular compartment inlets or members 14 are located. These nozzles 12 and inlets 14 are arranged around a central opening 16 through which workpiece 18 travels.

FIG. 2 clearly illustrates additional components and features of the header 10. It consists generally of an outer cylindrical hollow housing 20 having two ends 22 and 24 to which, as shown to the left of FIG. 2, a front circular plate 26 is affixed and as shown to the right of FIG. 2, rear circular plate 28 is fitted into the opening thereat. Both plates 26 and 28 have a central opening 30, 32 respectively, for receiving and supporting a tubular member 34 which extends out beyond the one end 24 of cylindrical housing 20 a distance to receive front plate 26, which is mounted onto tubular member 34. As FIG. 1 shows, front plate 26 is bolted to housing 20 at several locations, which is necessary in order to hold front plate 26 securely in place to counteract the weight of the water in chamber 36 pressing against front plate 26. The outer diameter dimension of rear plate 28 and the outer diameter of opening 32 of rear plate 28 are such that the rear plate is mounted around tubular member 34 to fit into cylindrical housing 20 at its end 22. Mounted around tubular member 34 and fitted into a cut out section of rear plate 28 is a seal retainer ring 40 for holding a gasket member 42 in place to prevent the water's escape from chamber 44 between the clearance 46 created by rear plate 28 mounted onto tubular member 34. Several bolts and nut assemblies 48 are arranged circumferentially to secure retainer ring 40 to rear plate 28.

The assemblage of cylindrical housing 20, front plate 26; rear plate 28, and tubular member 34 defines an overall enclosure which is divided into the two main chambers 36, 44 by inner annular member 50 mounted around and located approximately in the center of tubular member 34. This annular ring 50 is fixed into place by being welded to the inner surface of cylindrical member 20 and supports elongated inlet members 14. Water is permitted to flow from rear chamber 44 into front chamber 36 through openings 52 in flat annular ring 50, which openings 52 communicate with the severally arranged semicircular elongated member 14 and into which the water flows. For each elongated member 14 there is a corresponding cooperating opening 52. Elongated member 14 has a cut out chamfered section 54 shown in FIG. 2.

Welded to annular member 50 to the right of FIG. 2 is a two piece structure 58 which forms a smaller restrictive water compartment within the larger chamber 44. This two piece structure 58 consists of an extended annular ring 60 against whose right end with respect to FIG. 2, a flat annular plate 62 abuts. Annular member 62 is mounted around tubular member 34 and defines a clearance 64 which permits the flow of water from chamber 44 into the smaller chamber formed by two-piece structure 58.

Chamber 44 receives low pressure water which is brought into the header 10 through a supply inlet 62 located at the top of header 10 and communicating with right chamber 44. This inlet 61 is a circular member welded into an opening in cylindrical housing 20. A flange 63 mounted around inlet 61 permits header 10 to be connected by flexible means to the coolant supply lines.

The inner surface of tubular member 34 is chamfered at the left side of FIG. 2 where the workpiece enters the header 10 as it travels in the direction shown by the arrow. This chamfered portion permits easy and safe access of the workpiece into opening 16, and reduces the chances for any substantial damages of the workpiece 18 to occur.

FIGS. 1 and 3 illustrates clevis members 66 mounted to the right and bracket 68 mounted to the left of cylindrical housing 20. These members 66 and threaded bracket 68 allow for a vertical positioning of header 10 so that the workpieces can be better centralized upon their travel through header 10 and header 10 via clevis members 66 is fixedly mounted in the mill line or extrusion press. The desired positioning of header 10 in accordance with the diameter of the workpiece is accomplished through the adjustment of nut 70 on threaded post 72 which is stationarily mounted externally of the header assembly 10. The flexible connection of header 10 by flange 63 to the coolant supply line permits this desired vertical adjustment.

Nozzle assemblies 12 are arranged in tubular member 34 in the left chamber of header 10. FIGS. 1 and 2 illustrate the design and mounting of nozzle assemblies 12 in tubular member 34, which design is generally well-known in the art. The curtain walls are formed by the configuration of these nozzle assemblies, each consisting generally of two side walls 74 and two end walls 76, which generally form a rectangular structure having an elongated inlet opening 78 and an elongated outlet opening 80, which has a lesser cross-sectional area than the inlet opening 78. As shown in FIG. 2, the top of sidwalls 74 are chamfered and the two end walls 76 are higher than the sidewalls 74. This design directionalizes and optimizes the liquid coolant flow into the opening 78 of nozzle assembly 12. The outlet opening 80 is formed by tapered members 82 either affixed to or integral with sidewalls 74 which extend down into tubular member 34. As shown in FIG. 1, nozzle assembly 12 can be held in place in tubular member 34 through the use of a split ring 84 encircled and tightly fitted into a cut-out section on the outside of sidewalls 74. The construction of tubular member 34 and plate 26 is such that tubular member 34 along with nozzle assemblies 12 are removed and replaced as a unit, by unfastening bolts 38. This, in effect, allows easy access into the header 10 for maintenance and repair purposes, and nozzle assemblies 12 can be removed and replaced in tubular member 34 also, if necessary.

Naturally, the water issuing from the outlet opening 80 is in the form of a coherent curtain wall having a substantial longitudinal length, as shown in FIG. 2, which impinges radially and longitudinally onto the outer surface of workpiece 18 where it splits and travels in both directions away from the impingement area to form a film and to meet similar liquid films created by the neighboring water walls. This technique of coolant application provides a very efficient and compact cooling system which has the same as or greater cooling capabilities than the extended complicated present cooling systems.

The compact and thermally efficient design of this cooling header 10 permits it to be installed in areas having space limitation, yet deliver high volumes of coolant when needed to produce the desired microstructure and to so press oxide formation.

The path of the water flow in header 10 is as follows: Low pressure coolant which may be water enters left entry chamber 44 through inlet 61 where it flows around member 34 to better equalize the liquid pressure. From left chamber 44 it travels into smaller annular chamber of structure 58, and passes through openings 52 into the several elongated members 14 into right chamber 36. The flow is such it passes around in elongated member 14 down over its sides as shown in FIG. 1 where it is directed into the inlet passageway 78 of nozzle assembly 12, from where the curtain walls are delivered onto the traveling workpiece 18. One elongated member 14 serves to more uniformily deliver the flow to its two neighboring nozzle assemblies 12, or considered from a different perspective, two elongated members 14 cooperate to direct a uniform water flow into a nozzle assembly 12 located therebetween in a manner that the "non-opening" portions of the members 14 prevent the water issuing from the openings 52 from passing directly to the adjacent nozzle thereby further reducing pressure differences and obtaining smoother coolant flow. FIG. 1 clearly shows that the non-opening or semi-circular portion of elongated member 14 is located closest to the inlet of nozzle assembly 12. In other words, the non-opening portion has a convex form relative to the inner surface 21 of housing 20. Most of the joints of the components of header 10 are welded, and tightly sealed with a suitable sealant.

After impingement of the curtain walls radially along a longitudinal portion of workpiece 18, the coolant inside opening 16 flows out of both ends of tubular member 34 onto a work area, where it is properly disposed of. Workpiece 18 can be individual pieces or a continuous piece extending many feet which then is coiled.

In one application of the incorporation of the subject invention in an interstand relationship, effective cooling occurred of an approximately $\frac{5}{8}''$ diameter hot, rolled carbon steel rod traveling at approximately 3300 feet per minute. The cooling header 10 consisted of five equally spaced and radially arranged nozzles each measuring $2'' \times \frac{1}{8}''$ and each producing approximately 60 gallon per minute flow rate at an exit velocity of approximately 15 feet per second.

By the use of the subject invention, optimum finishing temperature control of the workpiece is achieved in a minimal amount of space, increasing the production rate and producing the desired microstructure and physical properties. This temperature control can be accomplished by using the type of header described herein between the stands of the finishing train to first obtain the optimum temperature for the increased production and at the runout section after the last stand to retain the optimum microstructure and minimize surface scale formation. Optimization of temperature control can be fully automated by the use of computers and temperature sensors.

In accordance with the provisions of the patent statutes, I have explained the principle and operation of my invention and have illustrated and described what I consider to represent the best embodiment thereof.

I claim:

1. In a hot metal working line where a liquid coherent curtain of coolant is applied to cool a generally round, hot metal workpiece, comprising:

header means, comprising: an enclosed housing including dividing means for separating said housing into a first chamber through which said coolant flows and a second chamber in communication with said first chamber for receiving said coolant and further including means constructed and arranged to form a central opening through which said workpiece travels, inlet means communicating with said first chamber for supplying said coolant into said header means, means concentrically located relative to said central opening constructed and arranged in said first chamber for diffusing said coolant supplied by said inlet means, and having a chamber and passages for restricting the flow rate of said coolant at it travels into said chamber of said diffusing means, a plurality of spaced-apart nozzle assemblies in said second chamber, radially arranged with respect to and concentrically spaced around said workpiece, each nozzle assembly having an elongated opening extending in a longitudinal direction along the length of said workpiece and constructed to deliver through said elongated opening said coolant in the form of a coherent curtain wall longitudinally along and radially onto an outer surface of said workpiece, coolant restraining and directing means in said second chamber having passageways communicating with said diffusing means of said first chamber, said coolant restraining and directing means arranged to alternate with at least two adjacent nozzle assemblies and constructed in a manner to receive and direct said coolant flow from said diffusing means of said first chamber into said immediately adjacent nozzle assemblies for said deliverance of said coherent curtain into said central opening of said header means onto said workpiece to effectively and uniformly cool said workpiece.

2. Header means according to claim 1, wherein said plurality of nozzle assemblies are evenly spaced and positioned circumferentially in said means for forming said central opening in said second chamber and each has a flow inlet section and a flow outlet section, and wherein each said coolant restraining and directing means is circumferentially arranged in said second chamber between at least said two nozzle assemblies.

3. Header means according to claim 2, wherein each said coolant restraining and directing means has a longitudinal length substantially equal to the transverse dimension of said second chamber, and has a member in the form of an open semi-circular configuration, and wherein said coolant flows around said semi-circular member and into said inlet section of said at least two adjacent nozzle assemblies.

4. Header means according to claim 3, wherein the length of said inlet section is substantially the same as that of said semi-circlar member.

5. Header means according to claim 1, further comprising:

adjustment means for positioning said header means in a manner said workpiece travels along the centerline of said central concentric opening and including means for securing said header means in said positioning.

6. Header means according to claim 1, wherein said housing is cylindrical and consists of detachable plate means mounted on said means for forming said concentric opening and constructed and arranged to be removed as a unit with said detachable plate means to permit access inside said header means upon removal therefrom.

7. Header means according to claim 6 wherein said nozzle assemblies are arranged in said means for forming said concentric opening, and further comprising retaining means for releasably securing said nozzle assemblies in said forming means so that said nozzle assemblies can be removed and replaced upon said removal of said detachable plate means and said forming means.

8. Header means according to claim 1, wherein said nozzle assemblies each consists of at least two end walls and two sidewalls whereby said sidewalls are lower than said endwalls so that said coolant is substantially restricted to flow over said sidewalls into said nozzle assembly.

* * * * *